US008365861B2

(12) United States Patent
Massini et al.

(10) Patent No.: US 8,365,861 B2
(45) Date of Patent: Feb. 5, 2013

(54) MUFFLER UNIT FOR FUME EXTRACTOR HOOD

(75) Inventors: Pietro Massini, Ancona (IT); Massimiliano Caimmi, Morro D'Alba (IT); Francesco Violi, Sant'Ilario D'Enza (IT); Marco Vizzaccaro, Tivoli (IT)

(73) Assignee: Ask Industries S.p.A., Monte San Vito (IT)

( * ) Notice: Subject to any disclaimer, the term of this patent is extended or adjusted under 35 U.S.C. 154(b) by 0 days.

(21) Appl. No.: 13/138,348

(22) PCT Filed: Feb. 17, 2010

(86) PCT No.: PCT/EP2010/052003

§ 371 (c)(1), (2), (4) Date: Aug. 4, 2011

(87) PCT Pub. No.: WO2010/094718

PCT Pub. Date: Aug. 26, 2010

(65) Prior Publication Data

US 2012/0018246 A1 Jan. 26, 2012

(30) Foreign Application Priority Data

Feb. 19, 2009 (IT) ..... MC2009A0032

(51) Int. Cl.
*F01N 1/06* (2006.01)

(52) U.S. Cl. ..... 181/206; 181/212; 181/225

(58) Field of Classification Search ..... 181/206, 181/212, 225

See application file for complete search history.

(56) References Cited

U.S. PATENT DOCUMENTS

| | | | | |
|---|---|---|---|---|
| 4,965,832 | A * | 10/1990 | Edwards et al. | 381/71.5 |
| 6,078,671 | A * | 6/2000 | Kawanishi et al. | 381/71.5 |
| 2004/0194776 | A1 * | 10/2004 | Amir | 126/299 R |
| 2005/0161283 | A1 * | 7/2005 | Emler | 181/249 |

* cited by examiner

*Primary Examiner* — Forrest M Phillips

(74) *Attorney, Agent, or Firm* — Lowe, Hauptman, Ham & Berner, LLP

(57) ABSTRACT

A muffler unit for a fume extractor hood includes an active noise suppression system, at least one loudspeaker, and at least two microphones connected to a control unit, and a passive noise suppression system having sound-absorbent material disposed between the microphones. The muffler unit further includes a conduit with upper fixing element and lower fixing element designed to be removably fixed to a motor unit and to a conveyor plate of the hood.

16 Claims, 9 Drawing Sheets

MUFFLER UNIT FOR FUME EXTRACTOR HOOD

The present patent application for industrial invention relates to a muffler unit for fume extractor hood and to a fume extractor hood obtained with said muffler unit.

Although the following description makes reference to a kitchen extractor hood, the present invention is also extended to an industrial extractor hood.

As it is known, an extractor hood comprises a fan disposed in an extraction conduit provided with inlet filter. The fan is driven into rotation by a motor in order to extract fumes through the extraction conduit.

These types of hoods are impaired by the high noise level, for the noise produced by the motor, the fan and the other moving mechanical parts, for the noise produced by the turbulent flow of air extracted in the hood conduit, and for the noise of the air that passes through the inlet filter.

Mechanical solutions are known to solve this drawback at least partially, such as:

- use of motors with rotors that produce low aerodynamic noise;
- mechanical uncoupling between motor and extraction conduit by means of rings and/or dampers;
- use of sound-absorbent materials in the motor housing or extraction conduit;
- use of acoustic barriers along the conduit (passive solutions, of muffler type); and
- aerodynamic optimization of filters to reduce the aerodynamic noise produced by the filters.

However, these mechanical solutions are not effective and the extractor hoods according to the known art are still very noisy.

The patent application EP 0 596 846 discloses a kitchen extractor hood provided with an active noise cancellation system. The hood is provided with sensors to detect noise, a loudspeaker that generates a sound adapted to suppress the noise and a control unit that controls the loudspeaker according to the noise detected by the microphones. Also this active noise cancellation system is characterised by poor efficiency, due to the physical structure and disposition of the components.

Moreover, the active noise cancellation system of EP 0 596 846 is integrated in the hood, making it not too versatile and not applicable to other hoods as separate module.

The U.S. Pat. No. 6,078,671 discloses a muffler unit to muffle the noise transmitted through a conduit. The cross-section of this muffler unit is circular.

The patent application US 2004/194776 discloses a hood with noise cancellation system integrated in the hood conduit. Therefore this patent application does not provide for a modular muffler system. Moreover, the hood conduit has a square cross-section.

The circular cross-section of the conduit of U.S. Pat. No. 6,078,671 and the square cross-section of the conduit of US 2004/194776 involve too much noise.

The purpose of the present invention is to eliminate the drawbacks of the known art, by providing a muffler system for fume extractor hood that is versatile and adapted to be applied to different types of hood without having to significantly change the structure and aesthetics of the hood.

Another purpose of the present invention is to provide such a muffler system for hood that is effective, efficacious and capable of guaranteeing high noise cancellation levels.

These purposes are achieved by the present invention, the features of which are claimed in the independent claim 1.

Advantageous embodiments are disclosed in the dependent claims.

The muffler unit for fume extractor hood according to the present invention comprises:

- an active noise suppression system comprising at least one loudspeaker, and at least two microphones connected to a control unit, and
- a passive noise suppression system comprising a sound-absorbing material arranged between said microphones.

The muffler unit comprises a conduit with upper fixing means and lower fixing means designed to be removably fixed respectively to a motor unit and to a conveyor plate of a hood. Moreover, the conduit of the muffler unit has a pentagonal cross-section.

The advantages of the muffler unit of the invention appear evident, since it can be easily mounted and dismounted also on existing hoods. The pentagonal cross-section of the conduit gives advantages in terms of noise suppression, as explained below.

Additional characteristics of the invention will appear evident from the following detailed description, which refers to merely illustrative, not limiting embodiments, illustrated in the enclosed drawings, wherein.

Figure 1:
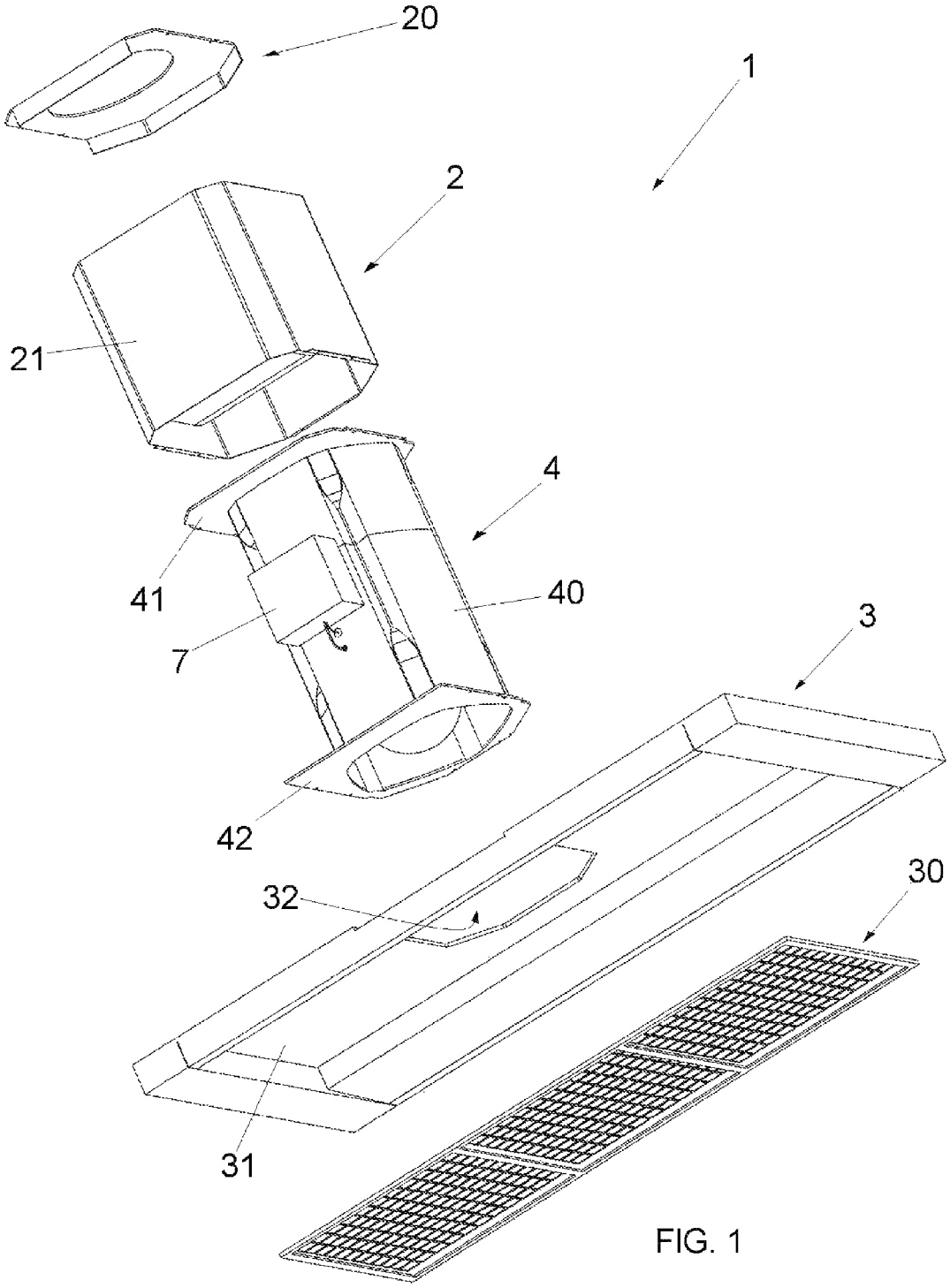
FIG. 1 is an exploded perspective view that shows a first embodiment of a hood with muffler unit according to the invention.
Figure 1A:
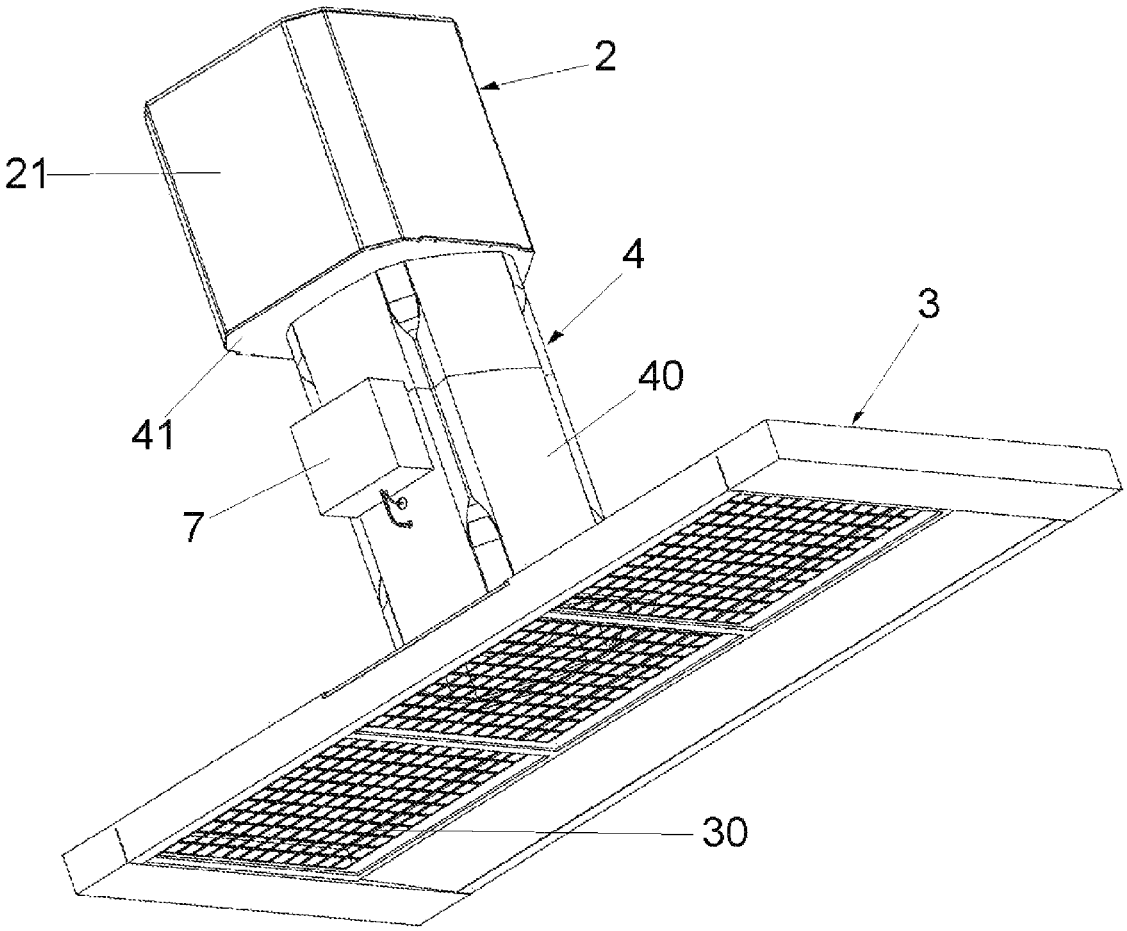
FIG. 1A is a perspective view that shows the hood of FIG. 1 in assembled condition.

Referring to FIGS. 1 and 1A, an extractor hood is disclosed, generally indicated with reference numeral (1).

The hood (1) comprises:

- a motor unit (2) provided with adapter (20) to fix the motor unit (2) to an exhaust conduit,
- a conveyor plate (3) containing a grate or baffle (30) and adapted to be arranged above the cooktop to convey fumes towards the inside of the hood, and
- a muffler unit (4) disposed between the motor unit (2) and the conveyor plate (3).

The motor unit (2) comprises a conduit (21) that houses an electrical motor that actuates a fan with axis orthogonal to the axis of the conduit (21).

The adapter (20) comprises a flange adapted to be fixed to the upper border of the conduit (21) of the motor unit and a conduit adapted to be connected to a fume exhaust conduit.

The conveyor plate (3) can be suitably shaped in accordance with the design of the hood. In any case the conveyor plate (3) is provided with a housing (31) to contain a grate or baffle (30) and an opening (32) to allow for passage of sucked air.

The muffler unit (4) comprises a conduit (40) provided with an upper flange (41) adapted to be fixed to the lower border of the conduit (21) of the motor unit and a lower flange (42) adapted to be fixed to the conveyor plate (3) in the opening (32) of the conveyor plate.

The muffler unit (4) is removably fixed to the conduit of the motor unit and to the conveyor plate in order to be dismounted and replaced easily.

Figure 3:
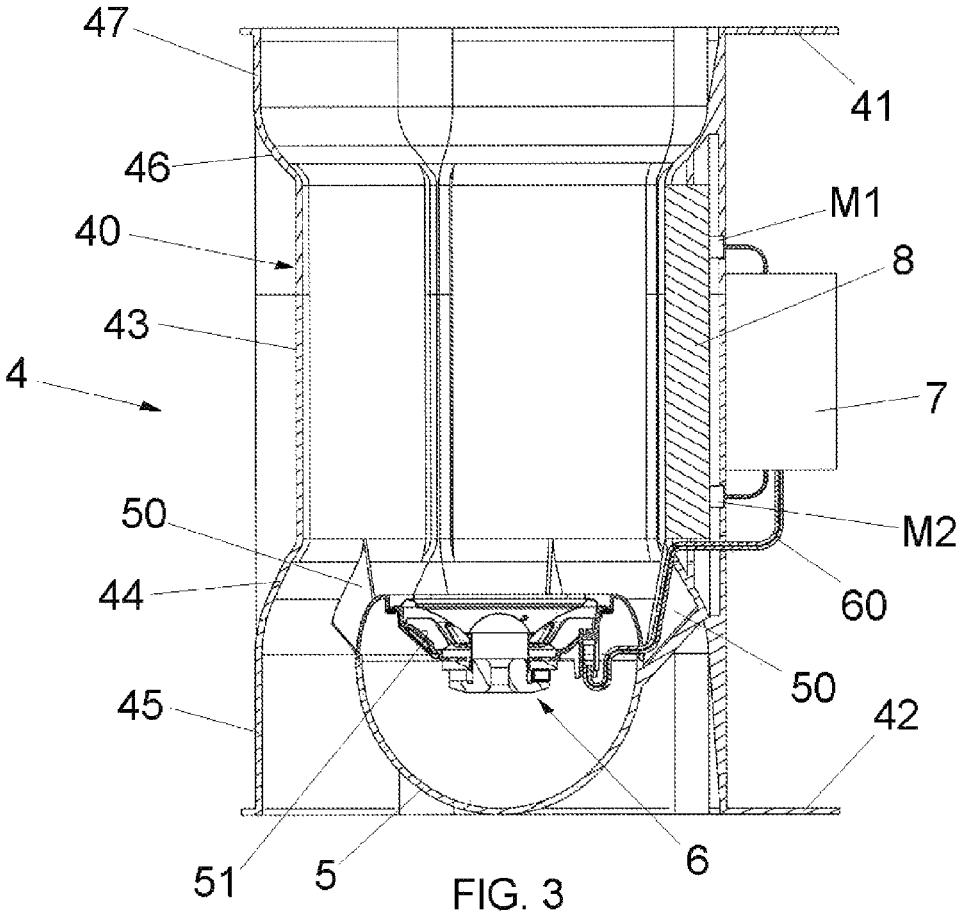
FIG. 3 is an axial cross-sectional view of the muffler unit, along section plane III-III of FIG. 2.

As shown in FIG. 3, the conduit (4) of the muffler unit comprises a central portion (43) that is connected by means of a tapered connection wall (44) to a lower portion (45) with higher width. The central portion (43) is connected by means of a tapered connection wall (46) to an upper portion (47) with higher width.

An ogival cover (5) with centre coinciding with the axis of the conduit (40) is disposed in the lower portion (45) of the conduit of the muffler unit. The cover (5) is supported by a plurality of radial brackets (50) that are fitted to the connection wall (44). An annular space is left between the cover (5) and the lower portion (45) of the conduit to permit the passage of the air being sucked. The shape of the cover (5) has been studied to facilitate the entrance of the air into the conduit (40) of the muffler unit.

A recessed seat (51) is obtained in the upper part of the cover (5), which contains an acoustic actuator or loudspeaker (6) with sound emission area facing upwards. The axis of the loudspeaker (6) coincides with the axis of the conduit (40) of the muffler unit.

The acoustic function of the cover (5) is to avoid the acoustic short circuit between the sound emitted from the front part of the membrane of the loudspeaker (6) and the sound, in push-pull, emitted from the back part of the same membrane. In this case (as shown in FIGS. 3, 5, 7, 9, and 12) the loudspeaker is defined as "closed-box", the back air volume being enclosed hermetically. Alternatively, the "reflex-box" assembly can be used, in which the air volume of the "speaker" is put in communication with the outside through a suitably dimensioned conduit.

An electrical cable (60) connects the loudspeaker (6) to a control unit (7) disposed outside the conduit (40) of the muffler unit. To that end, the electrical cable (60) passes through the cover (5), is guided by a bracket (50) and passes through the conduit (40) to be connected to the control unit (7). The control unit (7) preferably uses a DSP (Digital Signal Processor). The control unit (7) can also be arranged inside the cover (5).

Acoustic sensors or microphones (M1, M2) are arranged inside the conduit (40) of the muffler unit. More exactly, at least one reference microphone (M1) and at least one error microphone (M2) are provided. The two microphones (M1, M2) are preferably arranged in the central portion (43) of the conduit; precisely, the error microphone (M2) is arranged in closer position to the loudspeaker (6) compared to the reference microphone (M1).

The loudspeaker unit (6), control unit (7) and microphones (M1, M2) generate an active noise suppression system.

Sound-absorbent material (8) is disposed inside the conduit (40), preferably in the central portion (43) of the conduit (40), in such a way to be situated between the microphones (M1, M2) and the loudspeaker (6). The sound-absorbent material (8) covers the walls of the central portion of the conduit (40) in such a way to cover the microphones (M1, M2) and is a passive noise suppression system.

The sound-absorbent material (8) is preferably open-cell foam and in particular melamine foam.

It must be noted that there is a synergic effect between the active and the passive noise suppression system. With this configuration less aerodynamic noise is generated on the walls of the conduit (40) between the reference microphone (M1) and the loudspeaker (6). The noise generated in this area cannot be cancelled by the active control system.

The sound-absorbent material (8) is also used as excellent anti-wind filter for the microphones (M1, M2).

Figure 2:
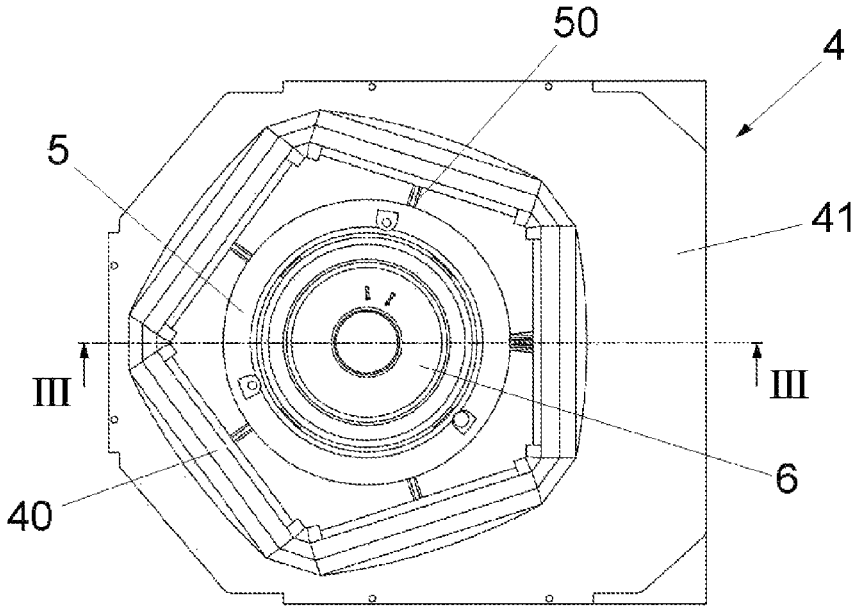
FIG. 2 is a top view of the muffler unit of the hood of FIG. 1.

As shown in FIG. 2, the cross-section of the conduit (40) and in particular the cross-section of the central portion (43) is of polygonal shape with odd number of sides, advantageously the cross-section of the conduit (40) is pentagonal. This configuration of the conduit (40) has two big advantages.

In fact, a higher uniformity of the acoustic field for frequencies higher than the cut-off frequency of the conduit (40) $f_c=c/(2L)$ is obtained, where c is the sound speed in the conduit and L is the higher transversal dimension. This effect is due to the fact that in a polygon with odd number of sides, the sides are never parallel, in fact each side "overlooks" a corner and not another parallel side. The two-by-two parallel walls of an enclosure are responsible for acoustic resonance that is difficult to muffle.

Moreover, the internal walls of the conduit (40) can be easily covered with sound-absorbent panels (8) of simple (parallelepiped) shape, without the need to bend said panels.

Figure 13:
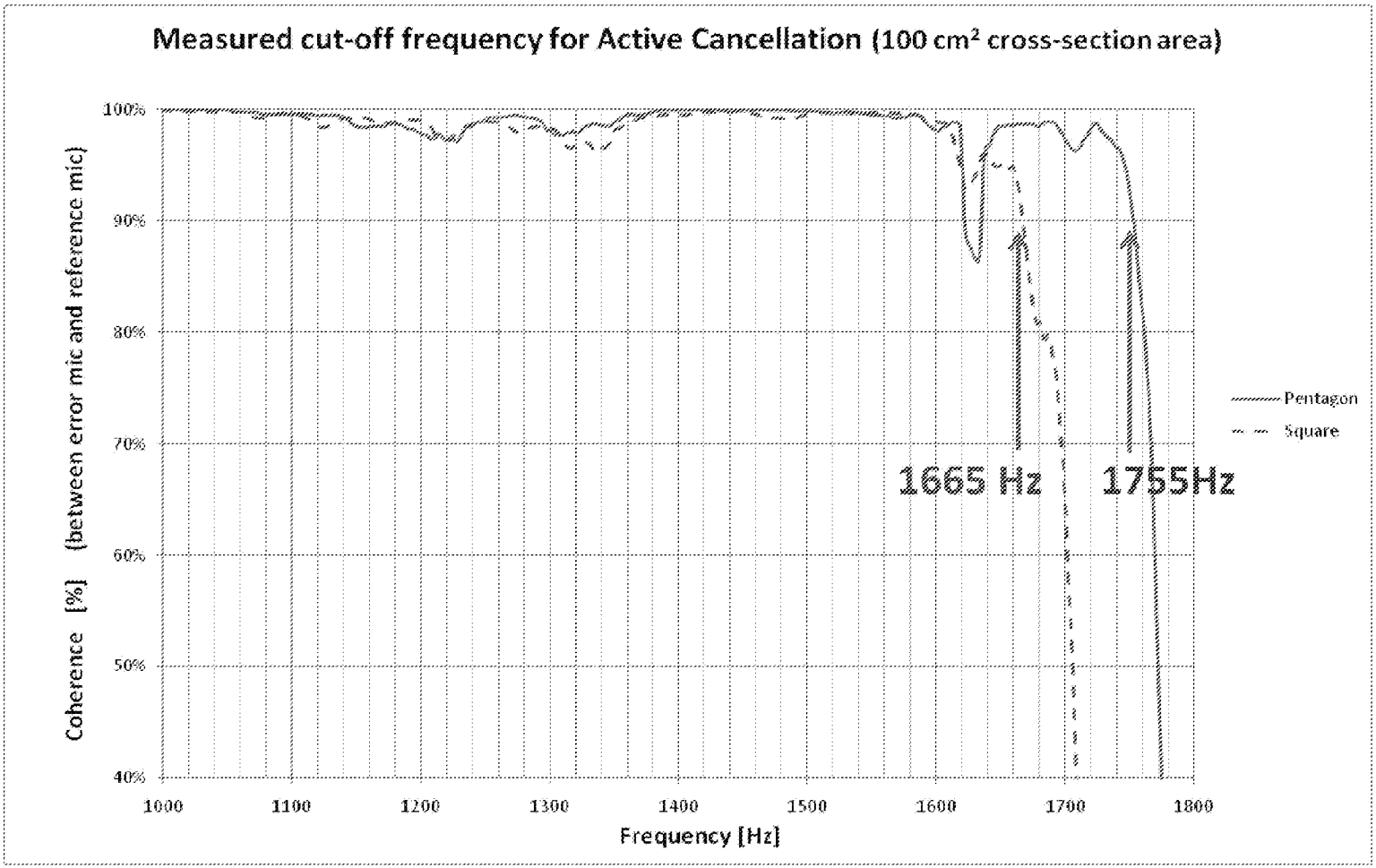
FIG. 13 is a chart that shows the coherence between error microphone and reference microphone, according to frequency, measured on a conduit with square cross-section and a conduit with pentagonal cross-section.

Experimental noise suppression tests have been performed on a conduit with square cross-section and on a conduit with pentagonal cross-section. The results of the tests are illustrated in the chart of FIG. 13 that shows the different cut-off frequency (Fc) of the two conduits with square section (shown with a broken line) and pentagonal section (shown with continuous line).

The Fc of a conduit with square section with 100 $cm^2$ area is 1665 Hz, whereas it is 1755 Hz for a conduit of pentagonal section with same area.

It must be noted that, in general, the ideal conditions for noise suppression exist under the Fc, for what concerns the spatial distribution of the acoustic field. In fact, an active noise cancellation (ANC) system uses a mono-dimensional acoustic model and the conduit, for $f<Fc$, is approximable to such a model.

These advantages allow the conduit with pentagonal section to reach 3 dB of active cancellation more than the conduit with square section.

Advantageously, the loudspeaker (6) is in coaxial position, in the centre of the transversal section of the conduit (40) to generate anti-noise with spatial distribution as coherent as possible with primary noise.

The muffler unit (4) of the invention guarantees noise cancellation at the error microphone (M2) of approximately 9.0 dBA with respect to the reference microphone (M1). The ambient sound level at 0.5 meters from the extractor hood (1) with muffler unit (4) is approximately 17 dBA lower than the sound level produced by the extractor hood without muffler unit.

In the following text identical elements or elements that correspond to the ones that have already been described are indicated with the same reference numerals, omitting their detailed description.

Figure 5:
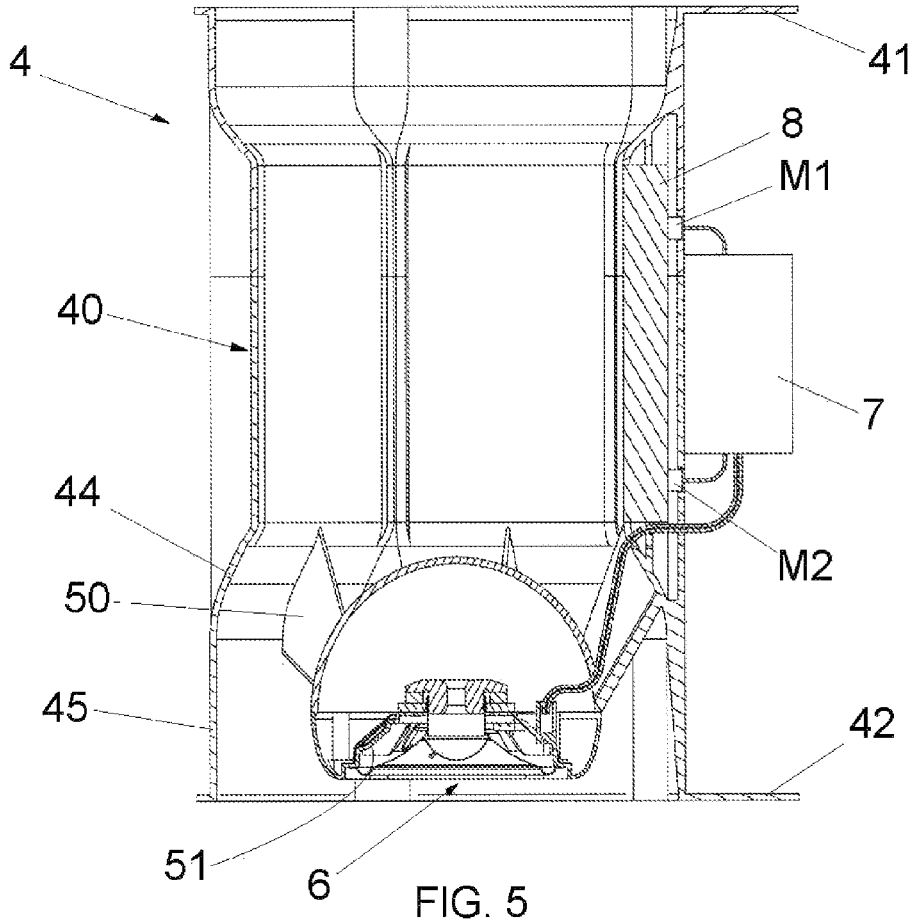
FIG. 5 is an axial cross-sectional view of the muffler unit, along section plane V-V of FIG. 4.
Figure 4:
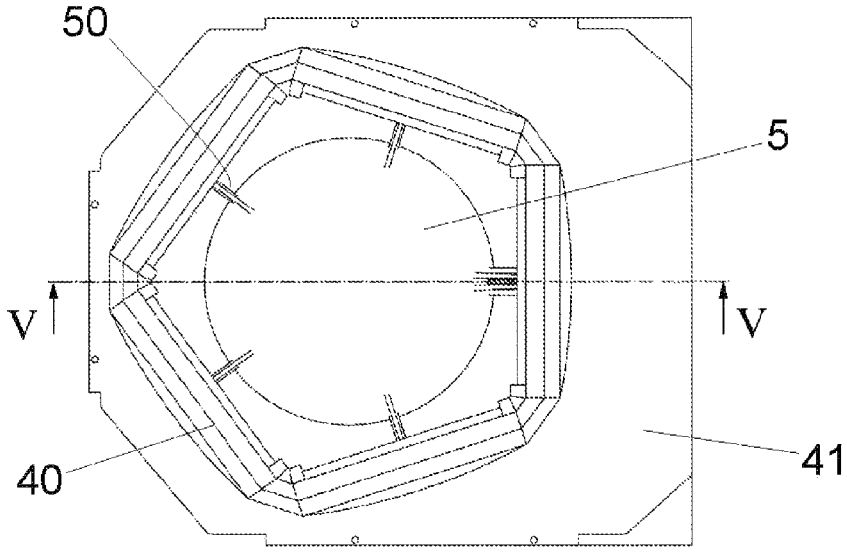
FIG. 4 is a top view of a first variant of the muffler unit of FIG. 3.

FIGS. 4 and 5 illustrate a first variant of the muffler unit (4), in which the sound emission area of the loudspeaker (6) is faced downwards. The sound emission has the same direction as the primary noise coming from the fan and motor unit.

Figure 7:
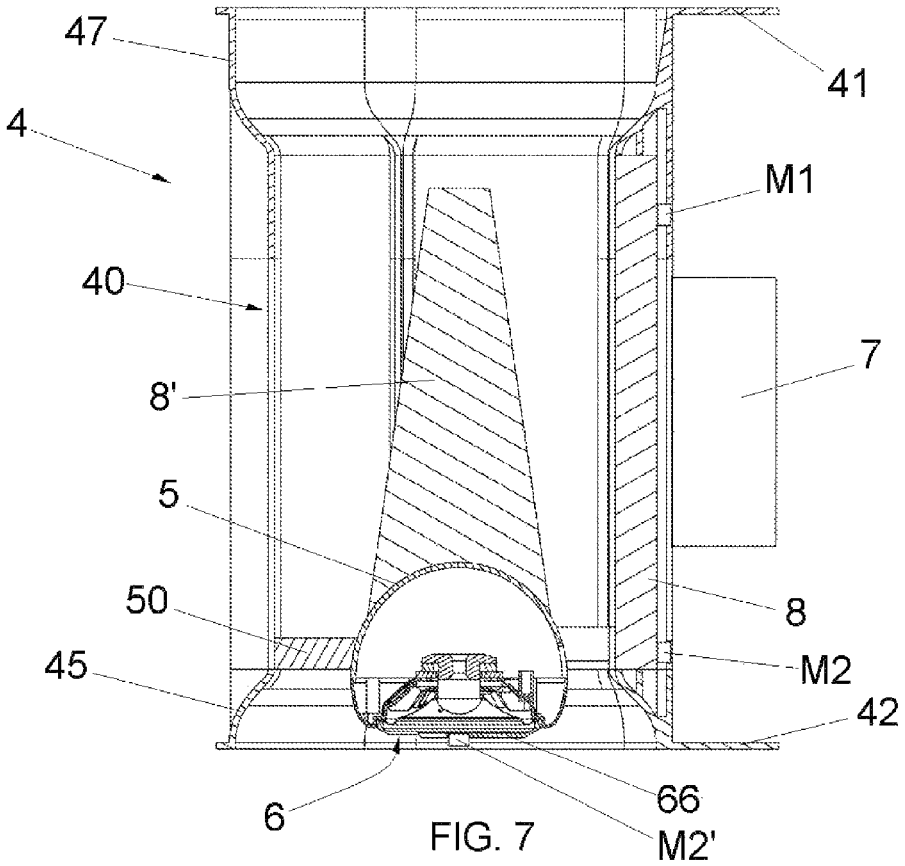
FIG. 7 is an axial cross-sectional view of the muffler unit, along section plane VII-VII of FIG. 6.
Figure 6:
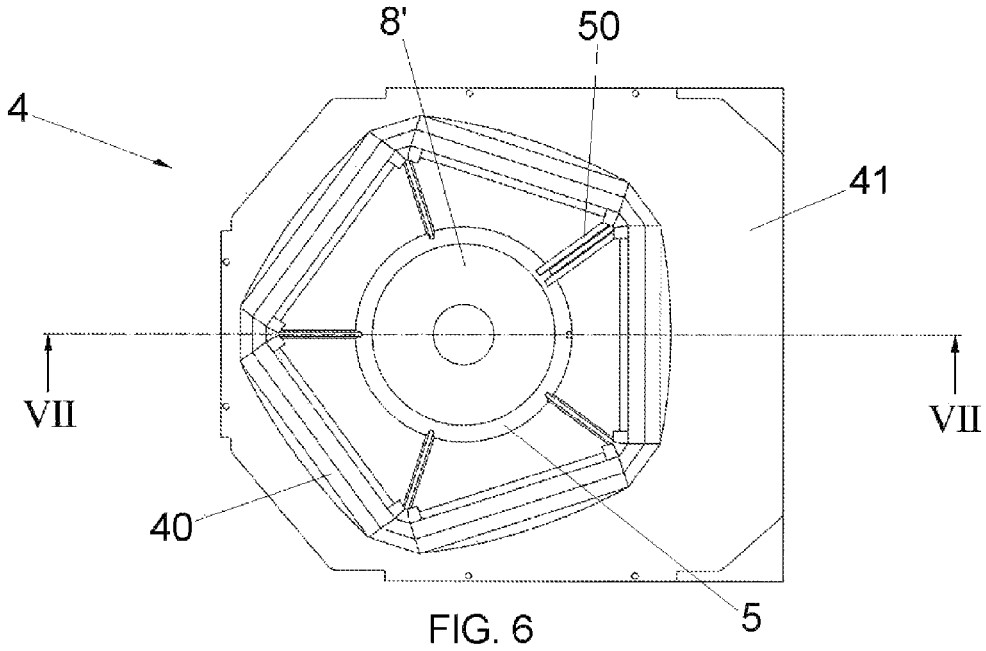
FIG. 6 is a top view of a second variant of the muffler unit of FIG. 3.

FIGS. 6 and 7 show a second variant of the muffler unit (4), in which the sound emission area of the loudspeaker is faced downwards and an element (8') made of sound-absorbent material is disposed above the cover (5) in coaxial position with respect to the conduit (40). Although the sound-absorbent element (8') preferably has a truncated-conical shape, it can have any shape, such as cylindrical or with triangular, square, pentagonal, etc, constant section.

The truncated-conical element (8') has a double function, since it gives higher aerodynamics to the air flow that is being sucked (less whirls behind the cover (5)) and increases the passive noise suppression part (higher attenuation of stationary waves and increase of cut-off frequency of the conduit (40)).

An error microphone (M2') can be disposed under the loudspeaker (6), for example on the grille (66) of the loudspeaker, preferably in coaxial position with the axis of the loudspeaker (6).

The devices shown in FIGS. 6 and 7 can be used in the other variants and in the other embodiments of the invention.

Figure 9:
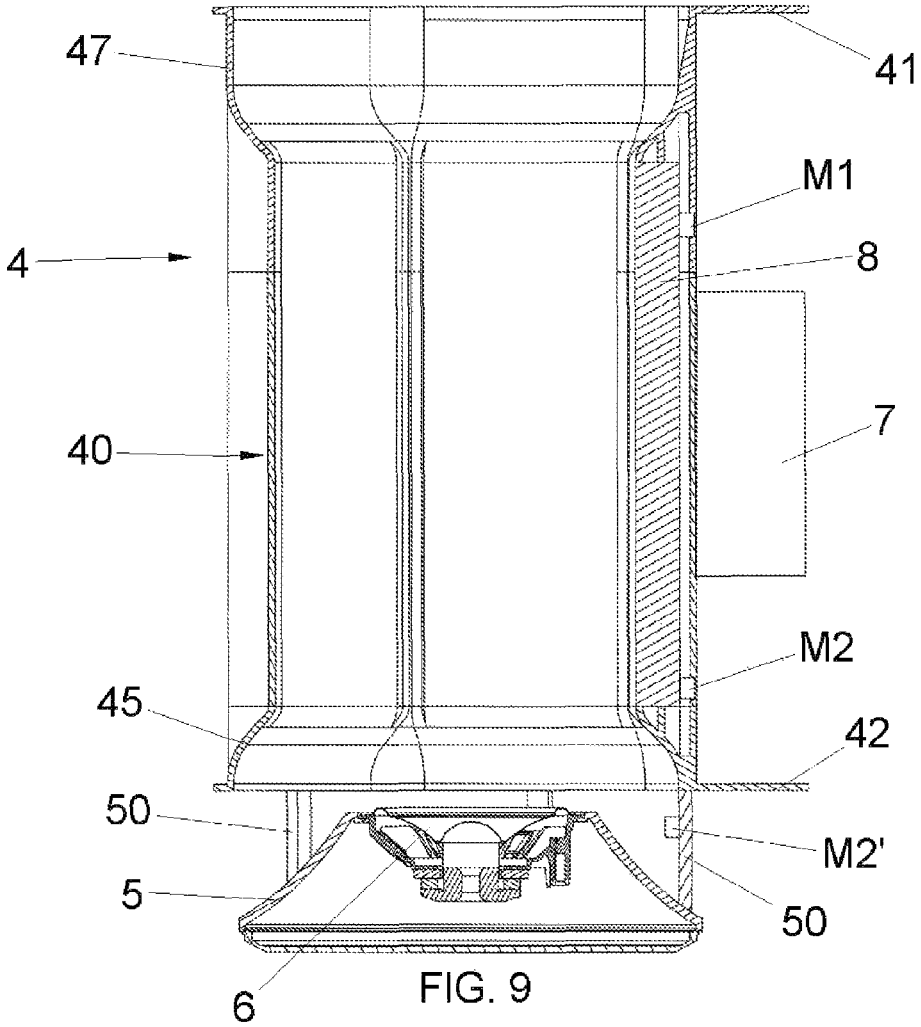
FIG. 9 is an axial cross-sectional view of the muffler unit, along section plane IX-IX of FIG. 8.
Figure 8:
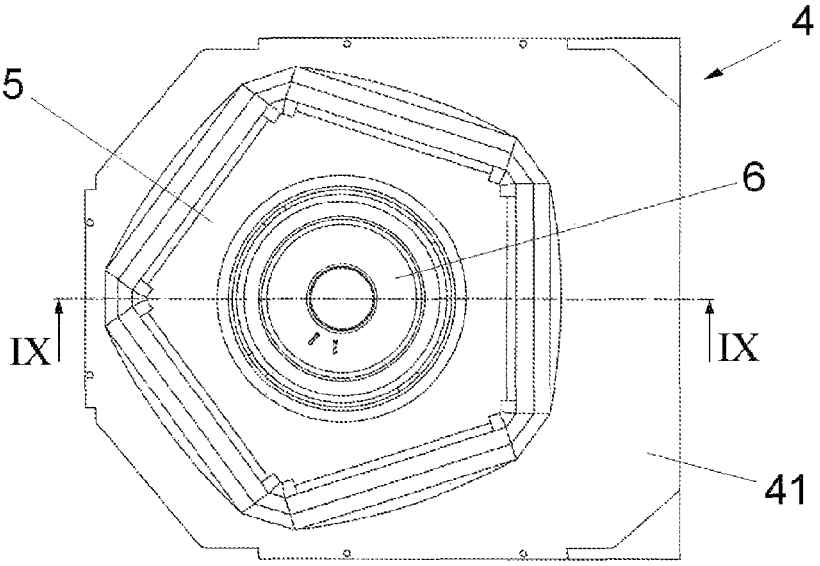
FIG. 8 is a top view of a third variant of the muffler unit of FIG. 3.

FIGS. 8 and 9 show a third variant of the muffler unit (4), in which the cover (5) that supports the loudspeaker (6) has a truncated-conical shape, and not an ogival shape, and is mounted under the lower part (45) of the conduit (4) by means of brackets (50).

In this case, the cover (5) will be recessed in the conveyor plate (3) of the hood.

An extractor hood is disclosed in the present embodiment, that is to say an extractor hood adapted to be connected to an exhaust conduit generally obtained in the wall of a building to exhaust the air that is being sucked outside of the building.

However, it must be noted that many buildings are deprived of exhaust conduit, or it is decided not to make the exhaust conduit for economic or aesthetic reasons, when the hood is installed far from the external walls. For these reasons filtering hoods are very popular, meaning hoods that exhaust the sucked air directly in the room where the hood is installed. In this case, part of the noise of the hood is due to the exhaust of the air in the internal ambient.

Figure 10:
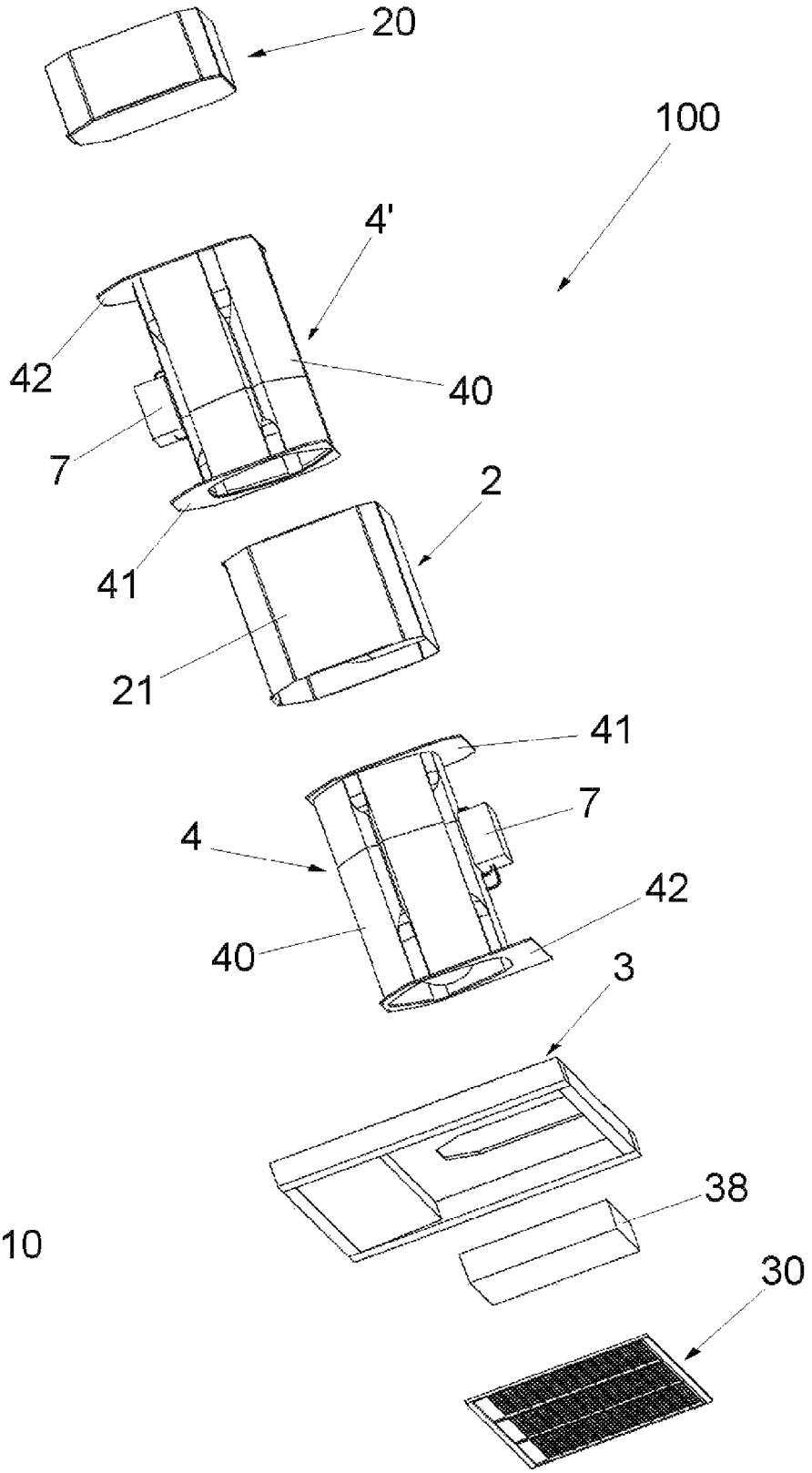
FIG. 10 is an exploded perspective view that shows a second embodiment of a hood (filtering hood) with two muffler units according to the invention.

As shown in FIG. 10, in order to solve such a drawback, a filtering hood (100) can be provided with a second muffler unit (4'), which is basically similar to the first muffler unit (4) described above.

While the first muffler unit (4) is installed upstream the motor unit (2), the second muffler unit (4') is installed downstream the motor unit (2), that is to say between the motor unit (2) and the exhaust.

The hood (100) is provided with a replaceable active carbon filter (38) arranged in the conveyor plate (3).

Figure 12:
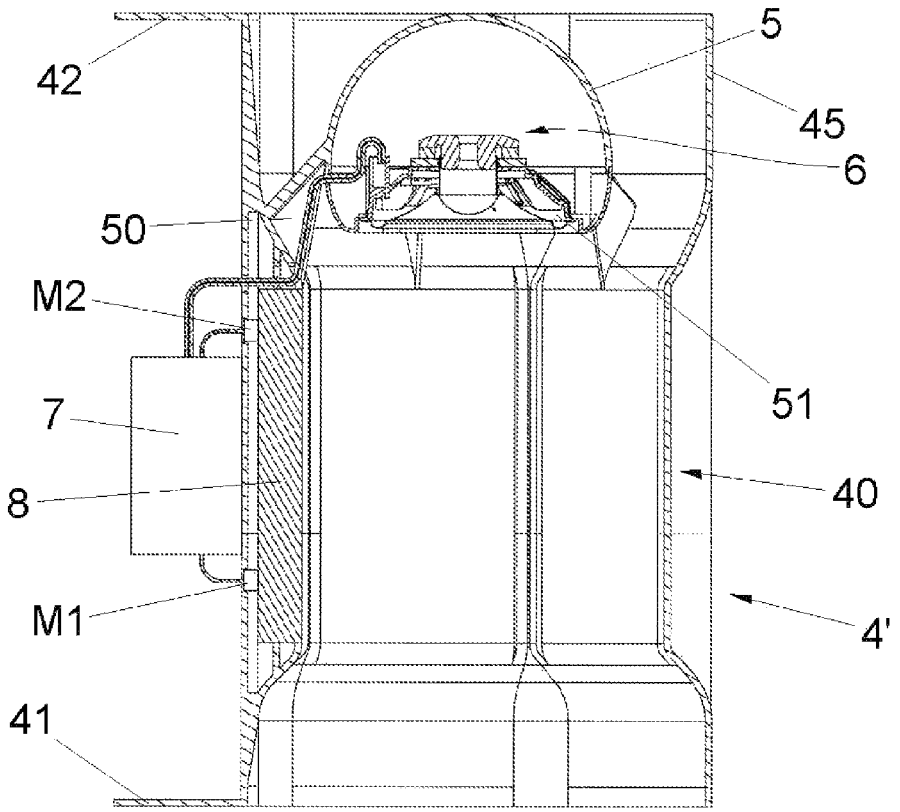
FIG. 12 is an axial cross-sectional view of the muffler unit, along section plane XII-XII of FIG. 11.
Figure 11:
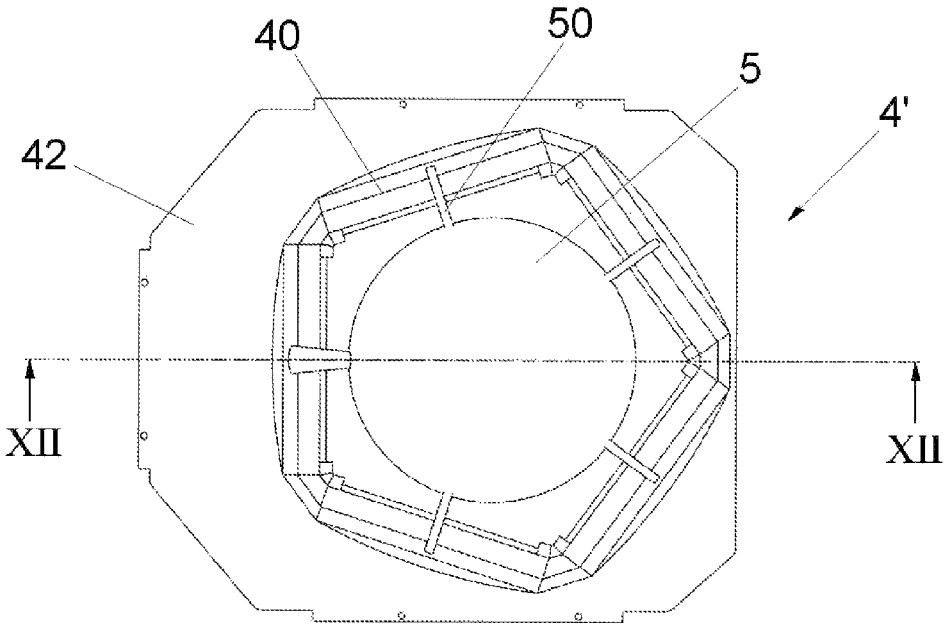
FIG. 11 is a top view of the muffler unit of FIG. 10.

As shown in FIGS. 11 and 12, the second muffler unit (4') is rotated by 180° with respect to the first muffler unit (4).

In the first muffler unit (4) between conveyor plate (3) and motor unit (2), primary noise is propagated in opposite direction to the air flow, whereas in the second muffler unit (4') between motor and exhaust, primary noise is propagated in the same direction as the air flow.

Variants identical to the ones described for unit 4 can be advantageously applied to unit 4'.

Numerous variations and modifications can be made to the present embodiments of the invention by an expert of the field, while still falling within the scope of the invention as claimed in the enclosed claims.

The invention claimed is:

1. A fume extractor hood comprising:

a motor unit comprising a conduit that houses a motor for actuating a fan for air suction;

a plate comprising a filter adapted to be arranged above a space where fumes are to be sucked;

a muffler unit removably mountable between said motor unit and said plate, wherein said muffler unit comprises an active noise suppression system comprising at least a loudspeaker, at least two microphones connected to a control unit, a passive noise suppression system comprising a sound-absorbent material arranged between said microphones, and a conduit with an upper fixing element and a lower fixing element removably fixable to said motor unit and to said plate, respectively, wherein said conduit of said muffler unit has a pentagonal transversal section.

2. The fume extractor hood according to claim 1, wherein the pentagonal transversal section of said muffler unit includes sides having inner corners and outer corners, wherein the adjacent sides are connected each other at the inner corners and free of direct attachment to each other at the outer corners.

3. The fume extractor hood according to claim 2, wherein the sides of the pentagonal transversal section of said muffler unit are a regular pentagon with five equal sides.

4. The fume extractor hood according to claim 1, wherein the loudspeaker is arranged in a lower part of said conduit of said muffler unit, in a coaxial position with said conduit, and includes a sound-emitting surface facing upward.

5. The fume extractor hood according to claim 1, wherein the loudspeaker is arranged in a lower part of said conduit of said muffler unit, in a coaxial position with said conduit, and includes a sound-emitting surface facing downward.

6. The fume extractor hood according to claim 5, wherein said muffler unit further comprises a cover arranged in the lower part of said conduit of said muffler unit and supporting the loudspeaker, and radial brackets connected to said conduit of said muffler unit and supporting the loudspeaker to form an annular space between the cover and said conduit of said muffler unit for the air being sucked to pass through.

7. The fume extractor hood according to claim 6, wherein the cover has a truncated-conical shape and is situated under the lower part of said conduit of said muffler unit.

8. The fume extractor hood according to claim 7, wherein the cover has an ogival shape and is situated inside said conduit of said muffler unit.

9. The fume extractor hood according to claim 6, wherein said muffler unit further comprises a sound-absorbent element arranged above said cover in a coaxial position with respect to said conduit of said muffler unit.

10. The fume extractor hood according to claim 1, wherein said sound-absorbent material is an open-cell material.

11. The fume extractor hood according to claim 10, wherein the sound-absorbent material is melamine foam.

12. The fume extractor hood according to claim 1, wherein said conduit of said muffler unit comprises a central portion and a lower portion, and the central portion is connected by a tapered connection wall to the lower portion in which the loudspeaker is arranged coaxially.

13. The fume extractor hood according to claim 12, wherein the at least two microphones are at least one reference microphone arranged in said central portion of said conduit, and at least one error microphone is closer to the loudspeaker than the reference microphone.

14. The fume extractor hood according to claim 12, wherein the error microphone is arranged under said loudspeaker.

15. The fume extractor hood according to claim 1, further comprising another muffler unit mounted between said motor unit and the fume exhaust conduit of the hood.

16. A muffler unit for a fume extractor hood including a motor unit for actuating a fan for air suction and a plate including a filter arranged above a space where fumes are to be sucked, the muffler unit being removably mountable between the motor unit and the plate and comprising:

an active noise suppression system comprising at least a loudspeaker;

a control unit;

at least two microphones connected to the control unit, a passive noise suppression system comprising a sound-absorbent material arranged between said microphones; and a conduit with upper fixing element and lower fixing element removably fixable to the motor unit and to the plate, respectively, wherein a transversal section of said conduit of the muffler unit has an odd number of sides, and the sides of the transversal section of the conduit are connected to each other at inner corners of the adjacent sides and free of direct attachment to each other at outer corners of the adjacent sides.

* * * * *